United States Patent [19]

Nelson

[11] 3,965,886

[45] June 29, 1976

[54] HOME FIREPLACE HEATING

[76] Inventor: Clifford H. Nelson, 9 Merry Point Terrace, Newport News, Va. 23606

[22] Filed: Oct. 15, 1975

[21] Appl. No.: 622,699

[52] U.S. Cl. ..... 126/121; 126/140; 237/51

[51] Int. Cl.[2] ..... F24B 7/00

[58] Field of Search ..... 126/120, 121, 128–131, 126/138, 140; 237/51

[56] References Cited

UNITED STATES PATENTS

| | | | |
|---|---|---|---|
| 32,283 | 5/1861 | Gauson et al. | 126/121 |
| 1,377,108 | 5/1921 | Williams | 126/121 |
| 1,488,195 | 3/1924 | Dawson | 126/121 |
| 2,052,643 | 9/1930 | Modine | 126/121 |
| 2,359,197 | 4/1944 | Brooks | 126/121 |
| 2,362,526 | 11/1944 | Austin | 126/121 |
| 3,190,282 | 6/1965 | Bauer | 126/131 |
| 3,762,391 | 10/1973 | Andrews | 126/121 |

*Primary Examiner*—William F. O'Dea
*Assistant Examiner*—Ronald C. Capossela

[57] ABSTRACT

This invention is designed to increase the heating efficiency of an existing conventional fireplace. The device consists of a hollow metal air conveying channel which is designed to fit closely against the multiple inside walls of an existing fireplace in combination with a hollow metal guide vane that connects the upper inside portions of the side arms of the air channel. The guide vane is triangular in cross section with the two lower sides surrounded by a V shaped metal plate, being spaced therefrom and thus forming an exhaust heat extraction channel which, in conjunction with a control damper, can force the hot fire gases to flow along these vane surfaces to transfer additional heat to the room air passing through the vane. The vane and V shaped exhaust channel assembly is positioned so as to form a hot gas passageway between the rear surface of the assembly and the upper portion of the center panel of the three sided air channel. An outer metal front closure is attached to the inner air channel subassembly, having two pairs of hinged doors providing for control of air input to fire, increased efficiency and maximum safety during untended periods of operation. The channel and vane are heated by the fire and room air is forced to make multiple horizontal passes through the fireplace heating channel and one pass through the guide vane by a blower. The heated room air being vented back into room. The device is readily insertible in an existing fireplace structure and does not interfere with its normal functioning. Because of this feature the device is compatible with a broad range of existing fireplace sizes and types.

4 Claims, 5 Drawing Figures

HOME FIREPLACE HEATING

CROSS REFERENCE TO RELATED APPLICATIONS

This application pertains to an improvement to my U.S. Pat. No. 3,896,785 issued on July 29, 1975 to Clifford H. Nelson.

DESCRIPTION OF THE PRIOR ART

Presently on the market are various devices that utilize the heat energy in a conventional fireplace to heat additional room air. These designs involve a metal structure that is placed losses inside a fireplace. Heating of room air is usually achieved by circulating room air through the device. Direction of this circulating room air is mainly vertical. In a departure from prior art this invention employs multiple horizontal passes of forced air flow to heat the room air. In addition to being an efficient extractor of heat from the fireplace, this invention has a minimum impact on the original appearance and decor of the fireplace. Other novel features include a unique guide vane, a V-shaped exhaust heat extraction channel that recovers heat normally lost up the chimney and has an attached front closure provided with two pairs of doors, reduces room air losses to the chimney, has means for increasing transfer of heat from the fire to the subject device, and when compared to prior art this invention further conserves the use of shortage fuels and reduces the use of electrical power.

BACKGROUND OF THE INVENTION

Our nation is currently faced with a projected shortage of energy derived from gas and fuel oil. This invention is directed toward reducing the use of these shortage fuels for heating individual houses.

Many American houses have fireplaces that could burn alternate fuels such as wood, coal, and other combustibles, but because the efficiency of the conventional fireplace is low, use as an alternate heating source is marginal.

The fireplace Heating Channel meets this need and transforms what has traditionally been primarily a decorative feature of the house into a more efficient generator of useful heat.

SUMMARY OF THE INVENTION

The fireplace Heating Channel consists of a metal air conveying channel designed to fit closely against the multiple inside walls of an existing fireplace and equipped with a guide vane in combination with a V-shaped exhaust heat extraction channel, an exhaust control damper and a front closure fitted with two pairs of doors and an air inlet damper. The air conveying channel and guide vane are heated by the fire and room air is forced to make multiple horizontal passes through the Fireplace Heating Channel by a blower. The heated room air is vented back into room yielding a substantial increase in the overall heat output from the fireplace.

The installation of the device does not interfere with the normal functioning of the existing fireplace and requires no modification of the basic structure.

DETAILED DESCRIPTION OF THE INVENTION

Figure 1:
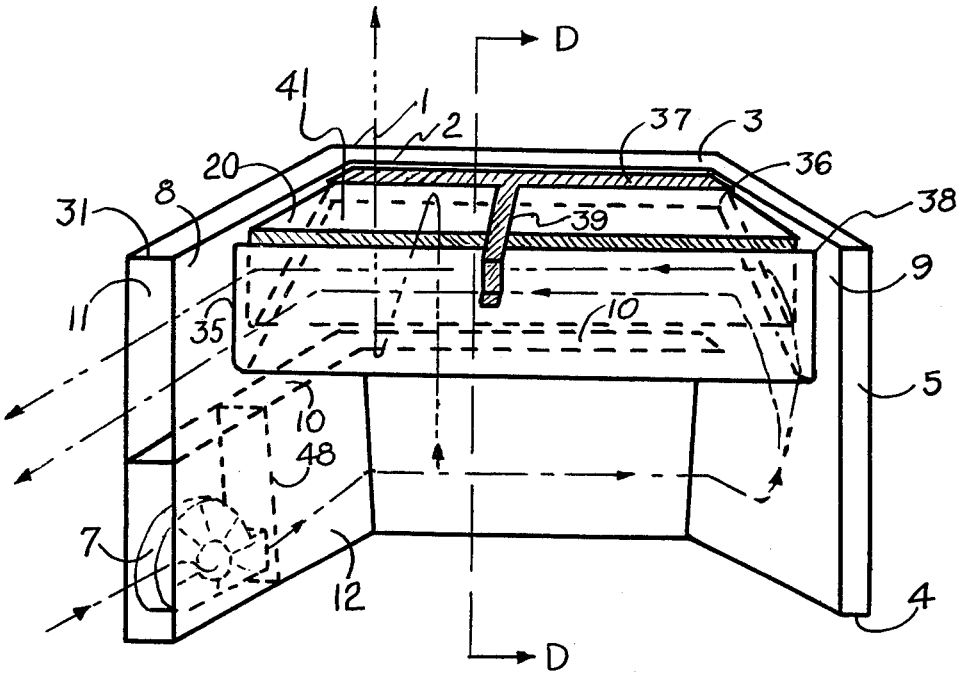
FIG. 1 is a schematic drawing of the inner subassembly of the invention illustrating the three sided air channel, guide vane, V-shaped exhaust heat extractor channel, the exhaust control damper and air blower. The front closure subassembly is not shown attached to achieve greater clarity of functional operation and description.

FIG. 1 is a schematic drawing of the rear subassembly only of the Fireplace Heating Channel assembly. For clarity of illustration and optimum descriptive coverage, the front closure which is an integral part of the overall assembly, is shown separately as FIG. 4. This rear subassembly is shown consisting of a free standing air channel 31 and guide vane 20 and a control damper 37 and a V-shaped exhaust heat extraction channel 35 designed to efficiently heat room air flowing through air channel 31 and guide vane 20. The air channel 31 is made of metal. It is a room air conveying channel 31 designed to be readily insertible into an existing conventional fireplace without requiring modification to the basic structure. The air channel 31 shown in FIG. 1 has three sides 8, 9, 2 which fit against the three inside fireplace walls. The air channel 31 is U-shaped, having a back or center arm, a left forward facing arm 8, and a right facing arm 9. The right arm 9 is somewhat shorter than the left arm 8. The front surface 2 of the channel 31 is separated from the back surface 1 by spacers 3,4,5. The spacers 3, 4, 5 are joined to the front 2 and back surface 1 in a manner to form air tight joints to prevent the entry of fire smoke and or the venting of room air from channel 31.

The metal guide vane 20 extends from the upper portion of left arm 8 to the right arm 9 and is hollow and triangular, or other suitable shape, in cross section and forms an air tight passage for room air between the two arms. The triangular sectioned vane 20 has its horizontal base near the top of the air channel 31 and the two other sides, forming an apex of a triangle, point downward. The guide vane 20 is positioned forward of the center or rear arm of the air channel 31 and the base surface is covered with heat insulation. A single blower directs the flow of room air into the lower horizontal air passage 12 of the air channel 31. The air outlet of the blower is fastened to the air tight partition 48. Baffle 10 indicated by dotted lines separates the left arm 8 and the center arm into two passages, one upper 11 and one lower 12. The right arm does not contain a baffle 10. The dot dash line of FIG. 1 indicates the route followed by the flow of air in making two horizontal passes through the air channel 31. The room air enters the lower passage at 12 and when it reaches the right arm 9 divided into two streams. One stream, indicated by a dot dash line, follows the upper passage of the air channel 31 and emerges at exit opening 11. The other stream indicated by a double dot dash line, passes horizontally through the guide vane 20 and also emerges at exit 11. The V-shaped exhaust heat extraction channel 35 is formed by a V-shaped metal plate 35 that is fastened to the inside upper walls of the forward facing arms 8,9 of the air channel 31 and positioned below and parallel to the underside surfaces of the guide vane 20 and suitably spaced therefrom to form a passageway 35 for hot gases prior to exiting up the chimney. An entrance into the exhaust heat extractor channel 35 is provided by locating the rear horizontal edge 36 of the V-shaped metal plate equidistance from the inside lower surface of the guide vane 20, and the upper center panel surface 2 and the top surface of the air channel 31, also see FIG. 2. Exit of the heat extraction channel is formed by positioning the horizontal forward edge 38 of the V-shaped metal plate 35 level with the guide vane base 20 and very close to the inside front surface of the fireplace throat 49, see FIG. 3. A converging upward passageway 41, also see FIG. 2 and 3, for hot gases immediately after leaving the fire is provided by the center panel surface 2 and the inward sloping surface of the V-shaped metal plate 35. The metal exhaust control damper 37 slides fore and aft on top of the horizontal base of the guide vane 20 and is shown in the rearward or closed position covering the rear slot 40, see also FIG. 2, formed by the top of the center panel 2 and the rear edge of the guide vane 20 base and bounded by the two upper inside surfaces of the forward facing arms 8,9. When the control damper 37 is in this rearward or closed position covering this slot 40 the hot fire gases are routed, as shown by the dot dot dot dash line, also see FIG. 2, into the exhaust heat extraction channel 35. The control damper is provided with an arm 39 extending to the fireplace front and providing for manual adjustment of the exhaust control damper 37. When the control damper is pulled forward to the open position the hot fire gases go directly up the chimney from the aforesaid slot 40 as shown by the dot dot dot dash line, also see FIG. 3.

The Fireplace Heating Channel inner subassembly comprised primarily of an air channel in combination with the guide vane, exhaust heat extraction channel, control damper for the exhaust gases and a single blower is designed to significantly increase the room heating efficiency of conventional fireplace, thereby achieving multiple advancements over prior art, including, (a) forming an upward converging passageway to increase the convective heat transfer from ascending gases to the upper center portion of the center panel of the air channel, (b) incorporating a uniquely designed V-shaped heat extraction channel providing transfer of significant amounts of heat energy to the circulating room air in the guide vane, which in prior art would be lost up the chimney, wherein the effective essence of this design feature is expressed by the large heating surfaces exposed to the hot gas exhaust stream prior to chimney release, (c) an exhaust control damper with provision for manual adjustment for routing exhaust gases through the Fireplace Heating Channel and thereby controlling the level of heat input to room and securing optimum fire starting conditions, (d) impede and greatly reduce the loss of excess room air to the chimney, which is a major loss of heat energy, as the V-shaped exhaust heat extraction channel is wide enough to nearly block the fireplace throat leaving only a converging passageway for hot fire gases to the rear and a much smaller gap in front of the channel, (e) as the downward facing V-shaped exhaust channel is much lower than the thick fireplace throat, most of the room air is forced to enter the fire at the combustion level where it is needed and the excess room air is further reduced so as to increase the overall heat recovery from the fire, (f) covering the top horizontal surface of the guide vane with insulating material to reduce loss of heat to chimney, (g) the horizontal passes of circulating air through the center panel of the air channel represent an advancement over prior art, which employ a vertical partition in the center panel causing dead air spaces to be created by the circulating room air on each side of the vertical baffle or partition, both in the upper and lower portions thereof, resulting in reduced transfer of heat energy to the circulating room air. In contrast the horizontal passes of the air in the subject invention enhances the transfer of heat to the circulating room air, in this center and hottest panel of the air channel, by eliminating dead air spaces, (h) with horizontal baffling, only one room air blower is required for air circulation as opposed to the two used in prior art, resulting in conservation and reduced use of electrical power for operating the fireplace.

Figure 2:
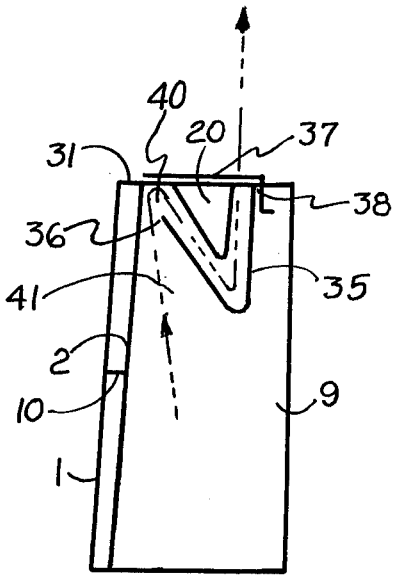
FIG. 2 is a schematic cross section D—D of FIG. 1.

FIG. 2 is a schematic drawing of the cross section D—D of FIG. 1 showing the control damper in the closed position thus routing ascending hot fire gases into the V-shaped exhaust heat extractor channel prior to exiting up the chimney.

Figure 3:
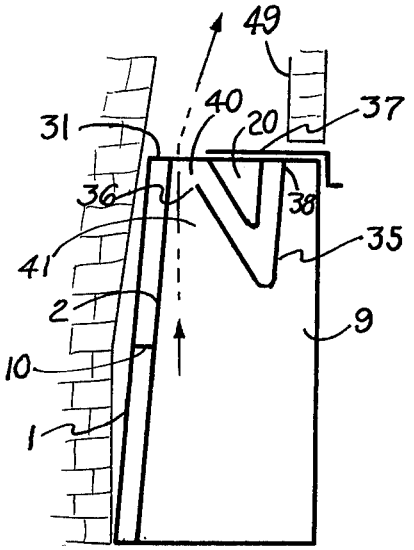
FIG. 3 is a schematic cross section D—D of FIG. 1 with the exhaust control damper shown in the front or open position.

FIG. 3 is a cross section schematic D—D of FIG. 1 showing the exhaust control damper in the open position to route the hot gases directly up the chimney rather than through the heat extractor channel. The approximate location of the mortar and brickwork of a conventional fireplace is indicated.

Figure 4:
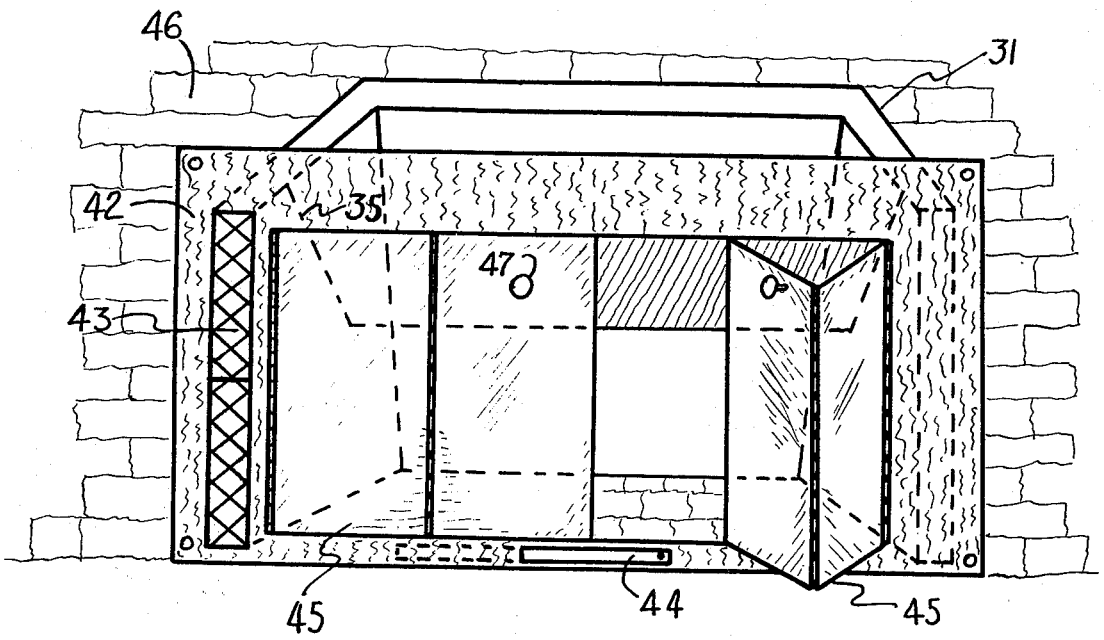
FIG. 4 is a schematic drawing primarily covering the front closure subassembly of the Fireplace Heating Channel showing front facing, two pairs of hinged access doors, adjustable air inlet damper and a partial view of the attached inner air channel subassembly.

FIG. 4 is a schematic drawing of the front closure subassembly shown attached to the rear air channel subassembly described in FIG. 1 and placed against the front face of an existing fireplace as a complete assembly. Front facing 42 is a decorative facing surrounding the fireplace opening and overlapping onto the existing brick front 46 and attached to the air channel 31 to form an integrated assembly that is free standing. The grill 43 covers the room air ducts for inlet and exhaust of circulating heating air. Two pairs of hinged doors 45 are indicated with the left side pair in the closed position and the right side doors partially open. For adjustment of inlet air to the fire a fire damper 44 is provided. It slides horizontally, being shown in the closed right hand position, full opening of this damper is secured by moving the metal fire damper to the left. Handles 47 are provided to facilitate opening and closing of the doors 45.

The front closure shown in FIG. 4 being an integral part of the free standing Fireplace Heating Channel, that is insertible as a complete assembly into an existing conventional fireplace, provides many advancements over prior art. With the doors open all the unique features of the air channel subassembly, as specified in the detailed description of FIG. 1 apply, namely cited examples (a) thru (h), and with the doors closed on this complete assembly many additional unique features and advantages become available, such as, (i) the most cogent advantage is the sharp rise in overall efficiency of operation. This is obtained through control of air to the fireplace. As the Fireplace Heating Channel is inserted into a fireplace and the front closure is brought against the outer facing of the fireplace, only very small openings or leakage areas are available to allow excess or uncontrolled air into the fire. The inlet fire damper can then be adjusted for the desired level of combustion. With the doors closed on the Fireplace Heating Channel, the operation is very similar to that of a furnace having a closed firebox with damper control of air input and with room air being heated by flowing around the firebox. Here then is the explanation for the sharp rise in overall thermal efficiency that can be achieved with the doors closed, (j) the door closure capability of the heating channel assembly provides for greater safety of operation. As when a big fire is burning and because of some unplanned event it must be quickly left untended, the doors can be closed for maximum safety during the period of absence, (k) the control of air input and door closure make it possible to keep the fireplace operating through the night. A large amount of fuel can be placed in the heating channel at bedtime and with the fire damper almost closed the combustion rate is so reduced that a very long period of burning can be achieved similar to the current practice of night operation of a coal fired furnace, (1) the householder may desire to secure maximum efficiency of operation during the daylight hours by keeping the doors closed and opening them only at times when the firelight is to be enjoyed, thus greatly extending the time between refueling.

Figure 5:
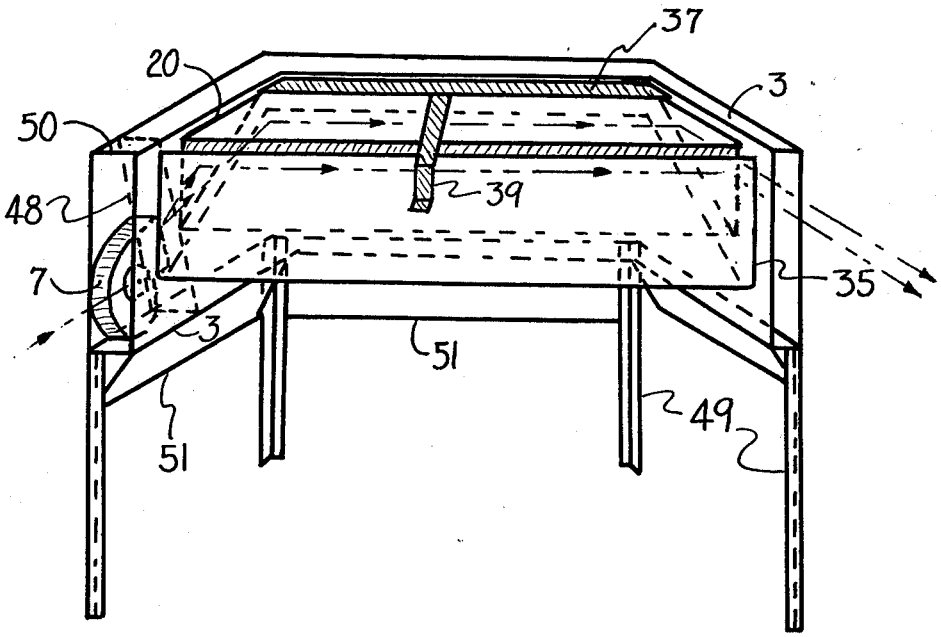
FIG. 5 is a schematic drawing of a simplified version of the Fireplace Heating Channel. The bottom half of the air channel, described under FIG. 1, has been removed and replaced by legs that are adjustable in height. The blower has been moved into the upper half of the air channel.

FIG. 5 is a schematic drawing of a simplified inner subassembly of the Fireplace Heating Channel as previously described in FIG. 1. The bottom half of the air channel has been removed and replaced by legs 49. The metal room air channel 50 has three adjoining arms that fit against the upper half of the three inside walls of an existing fireplace. Four legs 49 are attached to the air channel 50 and are adjustable in height to hold the air channel 50 firmly against the top throat of the fireplace. Metal fairings 51 are attached to the bottom of the air channel 50 and are bent inward so as to contact the inside fireplace walls. As previously described in FIG. 1, the three sided air channel 50 is provided with a guide vane 20 which is hollow and has a triangular cross section. The guide vane 20 is symmetrically located at the top of the air channel 50 and has fluid connection to the two forward arms of the air channel 50 at the point of attachment. A V-shaped heat extractor channel 35 is formed by a V-shaped metal plate that is positioned parallel to the lower sides of the guide vane 20 and spaced therefrom to form an exhaust channel, described in FIG. 1. The exhaust control damper 37 can be manually positioned fore and aft is similar to description in FIG. 1. The room air blower 7 has been moved up into the left arm of the shortened air channel 50 and forces the room air to make one horizontal pass through the air channel 50 exiting in the right arm as shown by the dot dash line and also one horizontal pass through the guide vane 20 indicated by the dot dot dash line venting also in the right arm.

This simplified inner subassembly of the Fireplace Heating Channel has the obvious advantage of lower fabrication cost without a proportional loss in overall thermal efficiency. In addition, as it is adjustable in height, it can be fitted more readily into fireplaces.

Even though the invention has been described specifically relative to features such as, shape of air channel, air passage configurations, locations of the room air entry and exit passages, the location and shape and size of the right and left arms of the air channel, means of forcing air flow through the channel, and the shape and location of the guide vane, the location of the V-shaped exhaust channel and its configuration, the exhaust gas damper control location and shape, the front closure facing with two pairs of doors and inlet and outlet ducts for the heated room air and the fire control damper, it is to be understood that these features are the preferred embodiments only. There are many modifications and variations to the several features of the present invention that can be made, all without departing from the spirit or scope of the invention as is defined in the following claims.

I claim:

1. A free standing fireplace heating channel comprised of an assembly consisting of a three sided hollow metal room air conveying channel in combination with a hollow metal air conveying guide vane and control damper means for routing hot fire gases as desired through a V-shaped exhaust heat extraction channel prior to exiting up the chimney, insertible into an existing conventional fireplace without requiring modification to the fireplace structure, said air conveying channel having a center panel and two forward facing arms and adapted to fit against the three inside walls of a fireplace, said channel having adjoining walls exposed to the heat from the fire with corresponding rear walls spaced therefrom and connected by spacer means so as to form a suitable air channel for conveying room air to be heated by the fire, means for forcing room air into a lower portion of said forward facing channel arm by a single blower, and baffle means to direct the forced circulating room air to make multiple horizontal passes through said channel prior to exiting back into a room from an upper portion of a forward facing channel arm as useful heated air, said guide vane being symmetrically attached to the upper inside portions of said forward facing arms, said hollow metal guide vane having a triangular cross section with the base horizontal and the apex pointing downward and positioned forward of the center panel, said guide vane having a hollow interior vented into the hollow interior of said channel arms at the point of attachment whereby said vane becomes an additional conveying channel for heating circulating room air, said V-shaped exhaust heat extraction channel being formed by a V-shaped metal plate fastened to the upper inside walls of the forward facing arms of the air channel and positioned below and parallel to the underside surfaces of the guide vane and suitably spaced therefrom to form a conveying means for hot fire gases prior to exiting up the chimney, entrance opening for the hot fire gases into the said heat extraction channel is formed by locating the rearward horizontal edge of said V-shaped metal plate approximately equidistance from the inside lower surface of the guide vane and the center panel surface and the top surface of the free standing air channel, exit opening of said heat extraction channel is formed by positioning the forward horizontal edge of the V-shaped metal plate level with the guide vane base and leaving a small gap between said edge and the inside front surface of the fireplace throat, a converging upward passageway for hot gases after first leaving the fire is provided by the center panel surface and the inner upward sloping surface of the V-shaped metal plate, the said control damper means slides on top of the guide vane base and in the closed or rearward position covers the rear slot formed by the center panel top and the rear edge of the guide vane base and the two upper inside surfaces of the forward facing arms, said control damper in the rearward or closed position routes the hot fire gases into the said exhaust heat extraction channel, said control damper means is provided with a metal arm extending to the fireplace front to provide for manual control and as said control damper is moved forward the hot fire gases go directly up the chimney through the thus opened aforesaid near slot.

2. A free standing fireplace heating channel as defined in claim 1 and additionally including a front closure assembly providing for closure of the fireplace front, venting and inlet of circulating room air to be heated, two pairs of doors and a fire control damper, whereby a metal facing means is attached to the inner assembly of the fireplace heating channel and when the whole assembly is inserted into a fireplace the said front facing means overlaps the fireplace opening and contacts both the front facing and the hearth of the fireplace thereby effecting an air seal against the passage of room air into the fire, whereas a fire control dampter means is provided for adjusting the air flow into fire, said door means includes two pairs of folding doors with one pair on the left and one pair on the right so as to provide full access to the fireplace interior and also providing a door closure means for preventing room air from entering the fire except as provided for by the fire control damper means, in addition the front facing means has circulating room air inlet and outlet openings which coincide with the inlet and outlet openings of the forward facing arm of the three sided inner air channel.

3. A free standing fireplace heating channel comprised of an inner assembly consisting of a three sided hollow metal room air conveying channel in combination with a hollow metal air conveying guide vane and control damper means for routing hot fire gases as desired through a V-shaped exhaust heat extraction channel prior to exiting up the chimney, the said three sided metal air conveying channel being provided with adjustable legs for vertical positioning, the said three sided metal air conveying channel having a center panel and two forward facing arms and adapted to fit against the three inside walls of a fireplace, said three sided metal air conveying channel having adjoining walls exposed to the heat from the fire with corresponding rear walls spaced therefrom and connected by spacer means so as to form a suitable air channel for conveying room air to be heated by the fire, means for inducing the flow of room air into one forward facing arm by a single blower placed therein so as to force exit of useful heated air out of the opposite forward facing channel arm, said guide vane being symmetrically attached to the upper inside portions of said forward facing channel arms, said hollow metal guide vane having a triangular cross section with the base horizontal and the apex pointing downward and positioned forward of the center panel, said guide vane having a hollow interior vented into the hollow interior of said channel arms at the point of attachment whereby said vane becomes an additional conveying channel for heating circulating room air, said V-shaped exhaust heat extraction channel being formed by a V-shaped metal plate fastened to the inside walls of the forward facing arms of the air channel and positioned below and parallel to the underside surfaces of the guide vane and suitably spaced therefrom to form a conveying means for hot fire gases prior to exiting up the chimney, entrance opening for the hot fire gases into said heat extraction channel is formed by locating the rearward horizontal edge of said V-shaped metal plate approximately equidistance from the inside lower surface of the guide vane and the center panel surface and the top surface of the three sided air channel, exit opening of said heat extraction channel is formed by positioning the horizontal forward edge of the V-shaped metal plate level with the guide vane base and having a small gap between said edge and the inside front surface of the fireplace throat, a converging upward passageway for hot gases after first leaving the fire is provided by the center panel surface and the inner upper sloping surface of the V-shaped metal plate, the said control damper means slides on top of the guide vane base and in the closed or rearward position covers the rear slot formed by the center panel top and the rear edge of the guide vane base and the two upper inside surfaces of the forward facing channel arms, said control damper in the rearward or closed position routes the hot fire gases into the said exhaust heat extraction channel, said control damper means is provided with a metal arm extending to the fireplace front to provide for manual control and as said control damper is moved forward the hot fire gases go directly up the chimney through the thus opened aforesaid slot.

4. A free standing fireplace heating channel as defined in claim 3 and additionally including a front closure assembly providing for the closure of the fireplace front, venting and inlet of circulating room air to be heated, two pairs of doors and a fire control damper, whereby a metal facing means is attached to the inner assembly of the fireplace heating channel and when the whole assembly is inserted into a fireplace the said front facing means overlaps the fireplace opening and contacts both the front facing and the hearth of the fireplace thereby effecting an air seal against passage of room air into the fire, whereas a fire control damper means is provided for adjusting the air flow into the fire, said door means includes two pairs of folding doors with one pair on the left and one pair on the right so as to provide full access to the fireplace interior and also providing a door closure means for preventing room air from entering the fire except as provided for by the fire control damper means, in addition the front facing means has circulating room air inlet and outlet openings which coincide with the inlet and outlet openings of the two forward facing arms of the three sided air channel.

* * * * *